US009477167B2

(12) United States Patent
Hara et al.

(10) Patent No.: US 9,477,167 B2
(45) Date of Patent: Oct. 25, 2016

(54) ELECTROSTATIC CHARGE IMAGE DEVELOPING WHITE TONER, ELECTROSTATIC CHARGE IMAGE DEVELOPER, AND TONER CARTRIDGE

(71) Applicant: FUJI XEROX CO., LTD., Tokyo (JP)

(72) Inventors: Satomi Hara, Kanagawa (JP); Masaru Takahashi, Kanagawa (JP); Shotaro Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/795,421

(22) Filed: Jul. 9, 2015

(65) Prior Publication Data

US 2016/0246199 A1 Aug. 25, 2016

(30) Foreign Application Priority Data

Feb. 24, 2015 (JP) ..... 2015-034580

(51) Int. Cl.
*G03G 9/09* (2006.01)
*G03G 9/087* (2006.01)

(52) U.S. Cl.
CPC ..... *G03G 9/0902* (2013.01); *G03G 9/08755* (2013.01)

(58) Field of Classification Search
CPC ..... G03G 9/0902; G03G 9/08755
See application file for complete search history.

(56) References Cited

U.S. PATENT DOCUMENTS

| | | | | |
|---|---|---|---|---|
| 4,946,506 | A * | 8/1990 | Arfaei | C04B 24/2647 106/724 |
| 5,180,650 | A | 1/1993 | Sacripante et al. | |
| 6,218,065 | B1 | 4/2001 | Tanikawa et al. | |
| 2004/0259009 | A1 | 12/2004 | Itami et al. | |
| 2013/0330522 | A1 * | 12/2013 | Suzuki | G03G 9/0902 428/195.1 |
| 2014/0349229 | A1 | 11/2014 | Morales-Tirado et al. | |

FOREIGN PATENT DOCUMENTS

| | | | |
|---|---|---|---|
| JP | H05281779 | A | 10/1993 |
| JP | H11237767 | A | 8/1999 |
| JP | 2005017470 | A | 1/2005 |
| JP | 2011197568 | A | 10/2011 |
| JP | 2014016598 | A | 1/2014 |
| JP | 2014228866 | A | 12/2014 |

* cited by examiner

*Primary Examiner* — Peter Vajda
(74) *Attorney, Agent, or Firm* — Oliff PLC

(57) ABSTRACT

An electrostatic charge image developing white toner includes toner particles that contain a binder resin, a titanium dioxide as a pigment and at least one selected from a group consisting of niobium and phosphorous, wherein an amount of the niobium is 0.005% by weight to 0.05% by weight or an amount of the phosphorous is 0.003% by weight to 0.05% by weight.

15 Claims, 2 Drawing Sheets

ELECTROSTATIC CHARGE IMAGE DEVELOPING WHITE TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-034580 filed Feb. 24, 2015.

BACKGROUND

1. Technical Field

The present invention relates to an electrostatic charge image developing white toner, an electrostatic charge image developer, and a toner cartridge.

2. Related Art

In the related art, as a white toner which is used in electrophotographic image forming, a white toner which includes titanium dioxide as a white pigment is known.

SUMMARY

According to an aspect of the invention, there is provided an electrostatic charge image developing white toner including:

toner particles that contain a binder resin, a titanium dioxide as a pigment and at least one selected from a group consisting of niobium and phosphorous, wherein an amount of the niobium is 0.005% by weight to 0.05% by weight or an amount of the phosphorous is 0.003% by weight to 0.05% by weight.

BRIEF DESCRIPTION OF THE DRAWINGS

Exemplary embodiments of the present invention will be described in detail based on the following figures, wherein.

DETAILED DESCRIPTION

Figure 1:
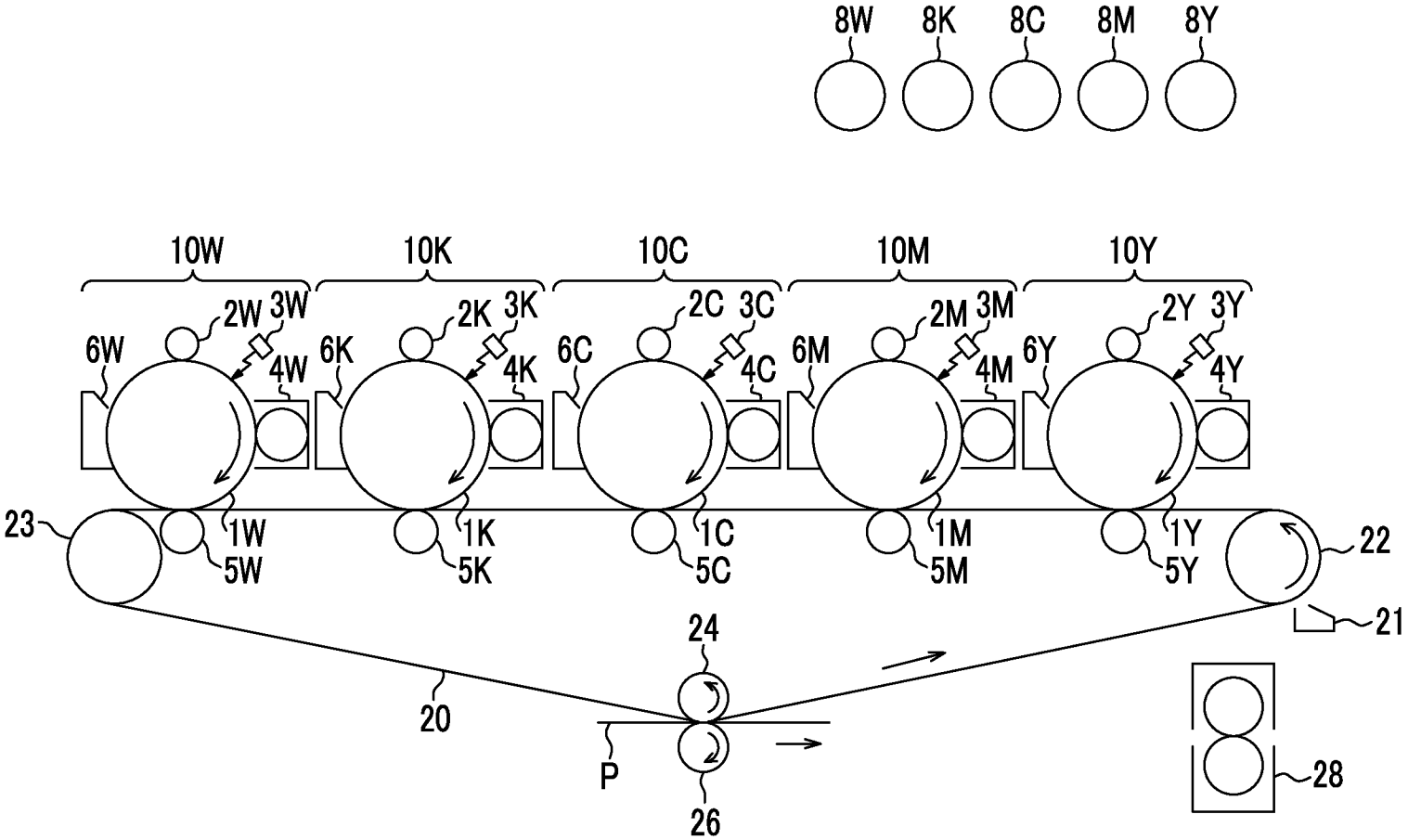
FIG. 1 is a schematic configuration diagram showing an example of an image forming apparatus according to the exemplary embodiment.

Herein, exemplary embodiments of the invention will be described. These description and Examples are examples of the exemplary embodiments, and the scope of the invention is not limited thereto.

In the specification, (meth)acryl means acryl or methacryl, (meth)acrylic acid means acrylic acid or methacrylic acid, and (meth)acrylo means acrylo or methacrylo.

Electrostatic Charge Image Developing White Toner

An electrostatic charge image developing white toner (also simply referred to as a "white toner") according to the exemplary embodiment includes toner particles which contain a binder resin, titanium dioxide ($TiO_2$) as a pigment, and at least either one of 0.005% by weight or more of niobium and 0.003% by weight or more of phosphorous. However, the contents of the niobium and the phosphorous in the toner particles each is equal to or less than 0.05% by weight. The white toner according to the exemplary embodiment is prepared by internally adding at least one of niobium and phosphorous to the toner particles in an amount within the above-described range.

With respect to the white toner having the configuration, deterioration of whiteness of an image due to an ultraviolet ray is unlikely to occur. The mechanism of action is not necessarily clear, but the followings are assumed.

With respect to a white image containing titanium dioxide as a white pigment, when light containing the ultraviolet ray, such as sunlight, shines thereon, the titanium dioxide absorbs an ultraviolet ray to exhibit a photocatalytic activity, whereby a part of a resin in the image is decomposed. As a result, a yellow tint is formed in the white image, and the whiteness of the image deteriorates.

Regarding the phenomenon, as the white toner according to the exemplary embodiment contains at least one of niobium of which the content is equal to or greater than 0.005% by weight and phosphorous of which the content is equal to or greater than 0.003% by weight in the toner particles, deterioration of the whiteness of the white image is unlikely to occur. Since niobium and phosphorous have an ultraviolet ray absorption action, when at least one of the niobium and the phosphorous is present in the white image in an amount described above, it is considered that decomposition of the resin is prevented by preventing the photocatalytic activity of the titanium dioxide, and deterioration of the whiteness of the image is prevented.

However, the contents of niobium and phosphorous in the toner particles in the exemplary embodiment are equal to or less than 0.05% by weight, respectively. While at least one of a niobium compound and a phosphorus compound is used in preparing the toner in order to contain at least one of niobium and phosphorous in the toner particles, the niobium compound and the phosphorous compound are likely to be ionized under a high temperature and high humidity (for example, environment in which the temperature is equal to or greater than 32° C. and the humidity is equal to or greater than 80%) to thereby effuse to a surface of the toner particles, so there is a case where a decrease in a charge amount of the toner is caused when the ion effuses, thereby forming an image deletion. For this reason, the contents of niobium and phosphorous in the toner particles are set to be in the above-described ranges, respectively.

In the exemplary embodiment, the content (% by weight) of niobium or phosphorous in the toner particles mean a value which is measured by an X-ray fluorescence analysis (XRF). For example, when the toner contains an external additive, the toner is added and dispersed to ion exchange water to which a surfactant is added, the external additive is removed from the surface of the toner particles by applying ultrasonic wave to the dispersion, and the content of niobium or phosphorous in the toner particles after removing the external additive is measured.

A condition for a measurement by the XRF and a method of preparing a sample for the measurement will be described later.

The white toner according to the exemplary embodiment contains the toner particles, and may further contain an external additive. In other words, in the exemplary embodiment, the toner particles may be used as a toner, and those obtained by adding an external additive to the toner particles may be used as a toner. Herein, a configuration of the white toner according to the exemplary embodiment will be described in detail.

Toner Particles

Titanium Dioxide

The white toner according to the exemplary embodiment contains titanium dioxide ($TiO_2$) as a pigment in the toner particles. The titanium dioxide may be any one of a rutile type, an anatase type, and an amorphous type.

Other White Pigments

The white toner according to the exemplary embodiment may contain other white pigments in addition to the titanium dioxide in the toner particles. Examples of other white pigments include silica, alumina, calcium carbonate, aluminium hydroxide, satin white, talc, calcium sulfate, magnesium oxide, magnesium carbonate, white carbon, kaolin, aluminosilicate, sericite, bentonite, and smectite. These white pigments may be surface-treated, and may be used together with a dispersant. The white pigments other than titanium dioxide may be used alone or in combination of two or more kinds thereof. These white pigments may be added into the toner particles for any purpose other than coloring (for example, for controlling a charge of the toner).

From the viewpoint of the whiteness of the image, in the white toner according to the exemplary embodiment, the content of the white pigments (total amount of titanium dioxide and other white pigments) in the toner particles is preferably from 20% by weight to 80% by weight, and more preferably from 40% by weight to 70% by weight.

In the white toner according to the exemplary embodiment, the content of titanium dioxide is preferably from 95% by weight to 100% by weight of the total amount of the white pigments contained in the toner particles, more preferably from 97.50% by weight to 99.95% by weight, and still more preferably from 98.50% by weight to 99.95% by weight.

In the white toner according to the exemplary embodiment, the content of titanium dioxide in the toner particles is preferably from 20% by weight to 80% by weight, and more preferably from 40% by weight to 70% by weight.

In the white toner according to the exemplary embodiment, the content of the titanium in the toner particles is preferably from 20% by weight to 50% by weight, and more preferably from 25% by weight to 47% by weight.

Niobium, Phosphorous

The white toner according to the exemplary embodiment contains at least one selected from a group of niobium (Nb) and phosphorous (P) in the toner particles.

The content of niobium in the toner particles is preferably from 0.005% by weight to 0.05% by weight, more preferably from 0.01% by weight to 0.05% by weight, still more preferably from 0.01% by weight to 0.04% by weight, still more preferably from 0.02% by weight to 0.04% by weight, and still more preferably from 0.02% by weight to 0.03% by weight.

The content of phosphorous in the toner particles is preferably from 0.003% by weight to 0.05% by weight, more preferably from 0.01% by weight to 0.05% by weight, still more preferably from 0.01% by weight to 0.04% by weight, still more preferably from 0.02% by weight to 0.04% by weight, and still more preferably from 0.02% by weight to 0.03% by weight.

In order to make niobium be contained in the toner particles, the compound containing niobium may be contained in the toner particles, for example, by using a compound which contains niobium in a step of preparing the white pigment or in a step of granulating the toner particles. Examples of the compound containing niobium include niobium alkoxide and carboxylate. Among these, from the viewpoint of easily diffusing into the resin, niobium alkoxide, such as niobium pentamethoxide, niobium pentaethoxide, and niobium pentabutoxide, is preferable.

In order to make phosphorous be contained in the toner particles, for example, by using a compound which contains phosphorous in the preparing step of the white pigment, or in the granulating step of the toner particles, the compound containing phosphorous may be contained in the toner particles. Examples of the compound containing phosphorous include phosphorous, phosphoric acid, phosphorous acid, various types of polyphosphoric acid, various types of phosphate, and various types of phosphate ester. Among these, from the viewpoint of colorlessness and transparency, phosphorous and phosphate are preferable.

In the exemplary embodiment, it is preferable to use a white pigment containing at least one selected from the group consisting of niobium and phosphorous on at least one of the surface and the inside thereof to prepare toner particles containing at least one of niobium and phosphorous.

Binder Resin

Examples of the binder resin of the toner particles include a polyester resin, an epoxy resin, a polyurethane resin, a polyamide resin, a cellulosic resin, a polyether resin, polystyrene, a styrene-alkyl(meth)acrylate copolymer, a styrene-(meth)acrylonitrile copolymer, a styrene-butadiene copolymer, and styrene-maleic anhydride copolymer. The resin may be used alone or in combination of two or more kinds thereof.

As the binder resin, the polyester resin is preferable. Example of the polyester resin includes a polycondensate of polyvalent carboxylic acid and polyol. As the polyester resin, a polyester resin which is available on the market may be used, or a synthesized polyester resin may be used.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic dials and alicyclic dials are preferably used, and aromatic diols are more preferably used as the polyol.

As the polyol, a tri- or higher-valent polyol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

While the polyester resin is a resin in which a ester group part thereof is likely to undergo hydrolysis due to moisture which is contained in the resin when the titanium dioxide exhibits a photocatalytic activity, according to the exemplary embodiment, even when the binder resin includes the polyester resin, deterioration of the whiteness of the image due to the ultraviolet ray is unlikely to occur.

As the polyester resin, from the viewpoint of a difficulty of decomposition when the titanium dioxide exhibits a photocatalytic activity, a polycondensate of aromatic carboxylic acids (e.g., terephthalic acid, isophthalic acid, phthalic anhydride, trimellitic anhydride, pyromellitic acid, and naphthalenedicarboxylic acid), and alicyclic diols (e.g., cyclohexanediol and cyclohexanedimethanol) or aromatic diols (e.g., ethylene oxide adducts of bisphenol A and propylene oxide adducts of bisphenol A) is preferable.

A glass transition temperature (Tg) of the polyester resin is preferably from 50° C. to 80° C., and more preferably from 50° C. to 65° C.

The glass transition temperature is obtained by a DSC curve obtained by differential scanning calorimetry (DSC). More specifically, the glass transition temperature is obtained by "extrapolating glass transition starting temperature" disclosed in a method of obtaining the glass transition temperature of JIS K7121-1987 "Testing Methods for Transition Temperatures of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight of the resin are measured by gel permeation chromatography (GPC). The measurement of the molecular weight by the GPC is performed by using an HLC-8120 manufactured by Tosoh Corporation as a measurement apparatus, a TSKGEL SuperHM-M15 cm manufactured by Tosoh Corporation as a column, and tetrahydrofuran as a solvent. The weight average molecular weight and the number average molecular weight are calculated by using a molecular weight calibration curve prepared by a monodispersed polystyrene reference sample from the measurement result.

The content of the binder resin is, for example, preferably from 40% by weight to 95% by weight, more preferably from 50% by weight to 90% by weight, and still more preferably from 60% by weight to 85% by weight with respect to the entirety of the toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

A melting temperature of the release agent is preferably from 50° C. to 110° C., and more preferably from 60° C. to 100° C.

The melting temperature of the release agent is determined by "Melting Peak Temperature" described in a method for determining a melting temperature of "Testing Methods for Transition Temperatures of Plastics" in JIS K 7121-1987 from a DSC curve obtained by differential scanning calorimetry (DSC).

The content of the release agent is, for example, preferably from 1% by weight to 20% by weight and more preferably from 5% by weight to 15% by weight with respect to the entirety of the toner particles.

Other Additives

Examples of other additives include known additives such as a magnetic material, a charge-controlling agent, and an inorganic powder. The toner particles contain these additives as internal additives.

Characteristics of Toner Particles

The toner particles may be toner particles having a single layer structure, or may be toner particles having a so-called core shell structure which is configured of a core (core particles) and a coating layer (shell layer) which coats the core. For example, the toner particles having the core shell structure may preferably be configured of a core which includes a binder resin and other additives, such as a coloring agent and a release agent as necessary, and a coating layer which includes the binder resin.

The shape factor SF1 of the toner particles is preferably from 110 to 150, and more preferably from 120 to 140.

The shape factor SF1 is obtained through the following expression.

$$SF1=(ML^2/A)\times(\pi/4)\times 100 \qquad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic image by the use of an image analyzer, and is calculated as follows. That is, an optical microscopic image of particles scattered on a surface of a glass slide is input to an image analyzer LUZEX through a video camera to obtain maximum lengths and projected areas of 100 particles, values of SF1 are calculated through the foregoing expression, and an average value thereof is obtained.

External Additives

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO—SiO_2$, $K_2O—(TiO_2)_n$, $Al_2O_3.2SiO_2$, $CaCO_3$, $MgCO_3$, $BaSO_4$, and $MgSO_4$.

The surface of the inorganic particles as an external additive is preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive also include resin particles (resin particles such as polystyrene, polymethylmethacrylate (PMMA), and melamine resin particles) and a cleaning activator (e.g., metal salt of a higher fatty acid represented by zinc stearate, and fluorine polymer particles).

The amount of the external additives externally added is, for example, preferably from 0.01% by weight to 5% by weight, and more preferably from 0.01% by weight to 2.0% by weight with respect to the toner particles.

Method of Preparing Toner

As to the white toner according to the exemplary embodiment, the toner particles are prepared, and the toner particles may be used as the toner, or those obtained by externally adding an external additive to the toner particles may be used as the toner.

In the exemplary embodiment, it is preferable to prepare toner particles by using a white pigment which contains at least one selected from the group of niobium and phosphorous on at least one of the surface and the inside thereof. As the white pigment, titanium dioxide particles are preferable.

Titanium dioxide particles which include niobium on the surface or the inside thereof may be prepared by blowing a liquid composition containing mixed therein titanium tetrabutoxide and niobium alkoxide (e.g., niobium pentamethoxide, niobium pentaethoxide, and niobium pentabutoxide), into an ultra-high temperature plasma of argon atmosphere, by the use of argon conveying gas.

The titanium dioxide particles which include phosphorous on the surface or the inside thereof may be prepared similarly to the description above, except that a phosphorus compound (e.g., disodium hydrogen phosphate) is used instead of niobium alkoxide.

In addition, for example, the titanium dioxide particles which include phosphorous on the surface or the inside thereof may be prepared by mixing the titanium dioxide particles and the phosphorous compound (e.g., disodium hydrogen phosphate) with each other and by forming a layer of the phosphorous compound on the surface of the titanium dioxide particles.

The toner particles may be prepared by any of a dry preparing method (e.g., a kneading and pulverizing method) and a wet preparing method (e.g., an aggregation and coalescence method, a suspension and polymerization method, and a dissolution and suspension method). The preparing method is not particularly limited to these methods, and a known preparing method is employed. Among these, a method of obtaining the toner particle by the aggregation and coalescence method is preferable.

Specifically, in the case of preparing the toner particles by the aggregation and coalescence method, the toner particles are prepared by a step (resin particle dispersion preparation step) of preparing a resin particle dispersion in which the resin particles are dispersed; a step (white pigment dispersion preparation step) of preparing a white pigment dispersion in which the white pigments are dispersed; a step (aggregated particle forming step) of forming aggregated particles by aggregating the resin particles and the white pigments, in a mixed dispersion in which the resin particle dispersion and the white pigment dispersion are mixed; and a step (coalescing step) of forming the toner particles by heating an aggregated particle dispersion in which the aggregated particles are dispersed to thereby coalesce the aggregated particles.

It is preferable that the white pigment include at least the titanium dioxide particles and the titanium dioxide particles include at least one of niobium and phosphorous.

Herein, each step of the aggregation and coalescence method will be described in detail. In addition, in the description below, a method of obtaining the toner particles which also contain the release agent will be described, but the release agent is used as necessary.

Resin Particle Dispersion Preparation Step

First, the white pigment dispersion in which the white pigments are dispersed and a release agent dispersion in which release agent particles are dispersed, are prepared together with the resin particle dispersion in which the resin particles which become a binder resin are dispersed.

For example, the resin particle dispersion is prepared by dispersing the resin particles in a dispersion medium with a surfactant.

Examples of the dispersion medium used for the resin particle dispersion include aqueous mediums.

Examples of the aqueous medium include water such as distilled water and ion exchange water, and alcohol. These may be used alone or in combination of two or more kinds thereof.

Examples of the surfactant include an anionic surfactant such as sulfate ester salt, sulfonate, phosphate, and soap; a cationic surfactant such as amine salt and quaternary ammonium salt; and a nonionic surfactants such as polyethylene glycol, alkylphenol ethylene oxide adduct, and polyol. Among these, the anionic surfactant and the cationic surfactant are particularly used. The nonionic surfactant may be used in combination with the anionic surfactant or the cationic surfactant.

The surfactants may be used alone or in combination of two or more kinds thereof.

Examples of a method of dispersing the resin particles in the dispersion medium include a general dispersing method which uses a rotation shearing type homogenizer or a ball mill, a sand mill, or a DYNO mill, which has a media. In addition, a phase inversion emulsification method may be employed in dispersing the resin particles in the dispersion medium. The phase inversion emulsification method includes: dissolving a resin to be dispersed in a hydrophobic organic solvent in which the resin is soluble; performing neutralization by adding a base to an organic continuous phase (O phase); and converting the resin (so-called phase inversion) from W/O to O/W by adding an aqueous medium (W phase), thereby dispersing the resin as particles in the aqueous medium.

The volume average particle diameter of the resin particles which are dispersed in the resin particle dispersion is preferably from 0.01 μm to 1 μm, and more preferably from 0.08 μm to 0.8 μm, and still more preferably from 0.1 μm to 0.6 μm.

In regard to the volume average particle diameter of the polyester resin particles, the particle size distribution which is obtained by measurement of a laser diffraction type particle size distribution measurement apparatus (for example, LA-700 manufactured by Horiba, Ltd.) is used, the cumulative distribution regarding the volume is drawn from the small particle diameter side with respect to the divided particle size range (channel), and particle diameter at which the volume becomes 50% with respect to the entire particle is set as the volume average particle diameter D50v. In addition, the volume average particle diameters of the particles in other dispersions are measured in a similar manner.

The content of the resin particle which is included in the resin particle dispersion is preferably from 5% by weight to 50% by weight, and more preferably from 10% by weight to 40% by weight.

Similarly to the resin particle dispersion, the white pigment dispersion and the release agent dispersion are also prepared. In other words, the dispersion medium, the dispersing method, the volume average particle diameter of the particles, and the content of the particle in the resin particle dispersion, are also similar in the white pigment dispersion and the release agent dispersion.

Aggregated Particle Forming Step

Next, the resin particle dispersion, the white pigment dispersion, and the release agent dispersion are mixed with each other.

In addition, in the mixed dispersion, the resin particles, the white pigments, and the release agent particles are heteroaggregated to form the aggregated particles having a diameter which is close to a targeted diameter of the toner particles.

Specifically, the aggregated particles are formed by adding an aggregating agent into the mixed dispersion, adjusting pH levels of the mixed dispersion to be acidic (e.g., from pH 2 to pH 5), adding a dispersion stabilizer as necessary, and then, performing heating to the temperature which is to be close to the glass transition temperature of the resin particles (specifically, for example, from −30° C. of the glass transition temperature of the resin particles to −10° C. of the glass transition temperature), to thereby aggregate the particles which are dispersed in the mixed dispersion.

In the aggregated particle forming step, heating may be performed after adding the aggregating agent at a room temperature (e.g., 25° C.) while stirring the mixed dispersion by the rotation shearing type homogenizer, adjusting pH levels of the mixed dispersion to be acidic (e.g., from pH2 to pH5), and adding the dispersion stabilizer as necessary.

Examples of the aggregating agent include a surfactant having a reverse polarity to that of a surfactant included in the mixed dispersion, inorganic metal salt, and a di- or higher-valent metal complex. When the metal complex is used as the aggregating agent, an amount of use of the aggregating agent is reduced, and charging characteristics are improved.

In combination with the aggregating agent, an additive which forms a complex with a metal ion of the aggregating agent or a bond similar to a bond to form a complex with a metal ion of the aggregating agent may be used. As the additive, a chelating agent may be appropriately used.

Examples of the inorganic metal salt include metal salt (e.g., calcium chloride, calcium nitrate, barium chloride, magnesium chloride, zinc chloride, aluminum chloride, and aluminum sulfate), and an inorganic metal salt polymer (e.g., polyaluminum chloride, polyaluminium hydroxide, and calcium polysulfide).

As the chelating agent, an aqueous chelating agent may be used. Examples of the chelating agent include an oxycarboxylic acid (e.g., a tartaric acid, a citric acid, and a gluconic acid), and an aminocarboxylic acid (e.g., an iminodiacetic acid (IDA), a nitrilotriacetic acid (NTA), and an ethylenediaminetetraacetic acid (EDTA)).

An amount of the chelating agent added is preferably from 0.01 parts by weight to 5.0 parts by weight, and more preferably 0.1 parts by weight or more and less than 3.0 parts by weight with respect to 100 parts by weight of the resin particles.

Coalescing Step

Next, the toner particles are formed by coalescing the aggregated particles by heating the aggregated particle dispersion in which the aggregated particles are dispersed, for example, at a temperature not lower than a glass transition temperature (e.g., equal to or greater than a temperature which is higher than the glass transition temperature of the resin particles by 10° C. to 30° C.) of the resin particles.

Through the above-described steps, the toner particles are obtained.

After finishing the coalescing step, a known washing step, a solid-liquid separation step, and a drying step are performed on the toner particles which are formed in the solvent, and thus the toner particles which are in a dried state are obtained.

With respect to the washing step, it is preferable to sufficiently perform displacement washing by the ion exchange water from the viewpoint of charge properties. In addition, the solid-liquid separation step is not particularly limited, but from the viewpoint of productivity, suction filtration, pressure filtration, or the like, may preferably be performed. In addition, the drying step is also not particularly limited, but from the viewpoint of productivity, freeze drying, flash jet drying, fluidized drying, vibration type fluidized drying, or the like, may preferably be performed.

The toner according to the exemplary embodiment is prepared, for example, by adding and mixing an external additive into the toner particles in a dried state. Mixing may preferably be performed by a V blender, a HENSCHEL mixer, or a LöDIGE mixer. As necessary, coarse particles of the toner may be removed by using a vibration classifier or a wind classifier.

Electrostatic Charge Image Developer

An electrostatic charge image developer according to the exemplary embodiment includes at least the white toner according to the exemplary embodiment. The electrostatic charge image developer according to the exemplary embodiment may be a single-component developer including only the white toner according to the exemplary embodiment, or a two-component developer obtained by mixing the toner with a carrier.

The carrier is not particularly limited, and a known carrier is used. Examples of the carrier include a coated carrier which is coated with the resin on a surface of a core which is made of magnetic powder; a magnetic powder dispersion type carrier in which the magnetic powder is dispersed and compounded in a matrix resin; and a resin impregnation type carrier in which a porous magnetic powder is impregnated with the resin. The magnetic powder dispersing type carrier and the resin impregnation type carrier may be carriers in which the configuration particles of the carriers are cores, and the surface of the cores is coated with the resin.

Examples of the magnetic powder include a magnetic metal (e.g., iron, nickel, and cobalt), and a magnetic oxide (e.g., ferrite and magnetite).

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinylketone, a vinyl chloride-vinyl acetate copolymer, a styrene-acrylate copolymer, a straight silicone resin having an organosiloxane bond or a modified product thereof, a fluorine resin, polyester, polycarbonate, a phenol resin, and an epoxy resin. The coating resin and the matrix resin may include additives, such as conductive particles. Examples of the conductive particles include a metal (e.g., gold, silver, and copper) and particles (e.g., carbon black, titanium oxide, zinc oxide, tin oxide, barium sulfate, aluminum borate, and potassium titanate).

Here, examples of the method of coating the surface of the core with the coating resin include a coating method using a coating layer forming solution in which a coating resin and various additives (which are used as necessary) are dissolved in an appropriate solvent. The solvent is not particularly limited, but may be selected in consideration of the type of the coating resin to be used or suitability in coating. Specific examples of the resin coating method include a dipping method of dipping the core in the coating layer forming solution, a spray method of spraying the coating layer forming solution onto the surface of the core, a fluidized bed method of spraying the coating layer forming solution in a state where the core floats by fluidized air, and a kneader-coater method of mixing the core of the carrier and the coating layer forming solution in the kneader-coater and then, removing the solvent.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to the exemplary embodiment will be described.

The image forming apparatus according to the exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to forma toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to the exemplary embodiment is applied.

In the image forming apparatus according to the exemplary embodiment, an image forming method (image forming method according to the exemplary embodiment) including a charging step of charging a surface of an image holding member, an electrostatic charge image forming step of forming an electrostatic charge image on the charged surface of the image holding member, a developing step of developing the electrostatic charge image formed on the surface of the image holding member with the electrostatic charge image developer according to the exemplary embodiment to form a toner image, a transfer step of transferring the toner image formed on the surface of the image holding member onto a surface of a recording medium, and a fixing step of fixing the toner image transferred onto the surface of the recording medium is performed.

As the image forming apparatus according to the exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus including a cleaning unit that cleans the surface of the image holding member, after transfer of the toner image and before charging; and an apparatus including an erasing unit that performs erasing by irradiating the surface of the image holding member with erasing light, after transfer of the toner image and before charging.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to the exemplary embodiment, for example, a part including the developing unit may have a cartridge structure (process cartridge) which is detachable from the image forming apparatus. As the process cartridge, for example, a process cartridge which accommodates the electrostatic charge image developer according to the exemplary embodiment and is provided with the developing unit is appropriately used.

The image forming apparatus according to the exemplary embodiment may be an image forming apparatus which further uses at least one toner selected from a yellow toner, a magenta toner, a cyan toner, and a black toner, in addition to the white toner according to the exemplary embodiment.

Hereinafter, an example of the image forming apparatus according to the exemplary embodiment will be described, but the exemplary embodiment is not limited thereto. In the following description, main parts shown in the drawing will be described, and the description of other parts will be omitted.

FIG. 1 is a schematic configuration view illustrating the image forming apparatus according to the exemplary embodiment, and is a view illustrating a quintuple tandem, type and an intermediate transfer-type image forming apparatus.

The image forming apparatus shown in FIG. 1 is provided with first to fifth electrophotographic image forming units 10Y, 10M, 10C, 10K, and 10W (image forming units) which output images of each color, such as yellow (Y), magenta (M), cyan (C), black (K), and white (W) based on color-separated image data. These image forming units (herein, there is cases where the image forming unit is simply referred to as a "unit") 10Y, 10M, 10C, 10K, and 10W are aligned in parallel to be separated from each other by a predetermined distance in a horizontal direction. These units 10Y, 10M, 10C, 10K, and 10W may be process cartridges which are detachable from the image forming apparatus.

Below each of the units 10Y, 10M, 10C, 10K, and 10W, an intermediate transfer belt (an example of an intermediate transfer member) 20 extends through each unit. The intermediate transfer belt 20 is provided to be wound around a driving roll 22, a supporting roll 23, and an opposing roll which are in contact with an inner surface of the intermediate transfer belt 20, and travels in a direction toward the fifth unit 10W from the first unit 10Y. On an image holding surface side of the intermediate transfer belt 20, an intermediate transfer member cleaning is provided facing the driving roll 22.

To each of developing devices (an example of the developing units) 4Y, 4M, 4C, 4K, and 4W in each unit 10Y, 10M, 10C, 10K, and 10W, each of yellow, magenta, cyan, black, and white toners accommodated in toner cartridges 8Y, 8M, 8C, 8K, and 8W is supplied.

Since the first to the fifth units 10Y, 10M, 10C, 10K, and 10W have similar configurations, operations, and actions as each other, here, the first unit 10Y which is arranged on an upstream side of a traveling direction of the intermediate transfer belt and which forms a yellow image, will be described as a representative example.

The first unit 10Y has a photoreceptor 1Y which operates as the image holding member. In the periphery of the photoreceptor 1Y, a charging roll (an example of the charging unit) 2Y which charges a surface of the photoreceptor 1Y to a predetermined potential, an exposure device (an example of the electrostatic charge image forming unit) 3Y which forms the electrostatic charge image by exposing the charged surface by using a laser beam based on a color-separated image signal, the developing device (an example of the developing unit) 4Y which supplies the toner to the electrostatic charge image and develops the electrostatic charge image, a primary transfer roll (an example of the primary transfer unit) 5Y which transfers the developed toner image onto the intermediate transfer belt 20, and a photoreceptor cleaning device (an example of the cleaning unit) 6Y which removes the toner that remains on the surface of the photoreceptor 1Y after the primary transfer, are disposed in order.

The primary transfer roll 5Y is disposed on an inner side of the intermediate transfer belt 20, and is provided at a position which faces the photoreceptor 1Y. Each of bias supplies (not shown) which apply a primary transfer bias are respectively connected to the primary transfer rolls 5Y, 5M, 5C, 5K, and 5W of each unit. Each bias supply changes a value of the transfer bias applied to each of the primary transfer rolls, by a control of a control portion which is not shown.

Hereinafter, an operation of forming a yellow image in the first unit 10Y will be described.

First, before the operation, a surface of the photoreceptor 1Y is charged to a potential of −600 V to −800 V by using the charging roll 2Y.

The photoreceptor 1Y is formed by laminating a photosensitive layer on a substrate having conductivity (for example, a volume resistivity at 20° C. is $1\times10^{-6}$ Ωcm or less). The photosensitive layer generally has high resistance (resistance of a general resin), but when the photosensitive layer is irradiated with the laser beam, specific resistance of apart which is irradiated with the laser beam changes. Here, the surface of the charged photoreceptor 1Y is irradiated with the laser beam from the exposure device 3Y, according to the image data for yellow which is sent from the control portion that is not shown. Accordingly, the electrostatic charge image having the yellow image pattern is formed on the surface of the photoreceptor 1Y.

The electrostatic charge image is an image which is formed on the surface of the photoreceptor 1Y by charging, and is a so-called negative latent image which is formed in the manner in which specific resistance of the irradiated part of the photosensitive layer is decreased by the laser beam from the exposure device 3Y, and charges on the surface of the photoreceptor 1Y flows, and meanwhile, the charge at a part which is not irradiated with the laser beam remains.

The electrostatic charge image formed on the photoreceptor 1Y is rotated up to a predetermined development position according to the running of the photoreceptor 1Y. In addition, the electrostatic charge image on the photoreceptor 1Y is developed and visualized as a toner image at the development position by the developing device 4Y.

In the developing device 4Y, for example, the electrostatic charge image developer which includes at least the yellow toner and the carrier is accommodated. The yellow toner is frictionally charged by being stirred the inside of the developing device 4Y, and is held on the developer roll (an example of a developer holding member) with a charge having the same polarity (negative polarity) as the charge on the photoreceptor 1Y. By allowing the surface of the photoreceptor 1Y to pass through the developing device 4Y, the yellow toner electrostatically attaches to an erased latent image portion on the surface of the photoreceptor 1Y, whereby the latent image is developed by the yellow toner. The photoreceptor 1Y on which a yellow toner image is formed is run continuously at a predetermined speed, and the toner image developed on the photoreceptor 1Y is transported to a predetermined primary transfer position.

When the yellow toner image on the photoreceptor 1Y is transported to the primary transfer position, a primary transfer bias is applied to the primary transfer roll 5Y, the electrostatic force toward the primary transfer roll 5Y from the photoreceptor 1Y acts on the toner image, whereby the toner image on the photoreceptor 1Y is transferred onto the intermediate transfer belt 20. The transfer bias applied at this time has a polarity (+) reverse to polarity (−) of the toner, and for example, is controlled to be +10 μA by the control portion (not shown) in the first unit 10Y.

On the other hand, the toner which remains on the photoreceptor 1Y is removed by the photoreceptor cleaning device 6Y and collected.

The primary transfer bias which is applied to the primary transfer rolls 5M, 5C, 5K, and 5W of the second unit 10M and the subsequent units is also controlled in the same manner as in the case of the first unit.

In this manner, the intermediate transfer belt 20 onto which the yellow toner image is transferred by the first unit 10Y is transported in order through the second to the fifth units 10M, 10C, 10K, and 10W, and the toner images having each color are multiply-transferred in a superimposed manner.

The intermediate transfer belt 20 which passes through the first to the fifth units, and on which the toner images having five colors are multiply-transferred, reaches a secondary transfer portion which is configured of the intermediate transfer belt 20, the opposing roll 24 which contacts with the inner surface of the intermediate transfer belt, and a secondary transfer roll (an example of the secondary transfer unit) 26 which is disposed on an image holding surface side of the intermediate transfer belt 20. Meanwhile, a recording sheet (an example of the recording medium) P is supplied to a gap between the secondary transfer roll 26 and the intermediate transfer belt 20, which are in contact with each other, through a supply mechanism at a predetermined timing, and a secondary transfer bias is applied to the opposing roll 24. The transfer bias which is applied at this time has polarity (−) which is the same polarity as polarity (−) of the toner, the electrostatic force toward the recording sheet P from the intermediate transfer belt 20 acts on the toner image, whereby the toner image on the intermediate transfer belt 20 is transferred onto the recording sheet P. The secondary transfer bias at this time is determined according to the resistance which is detected by a resistance detecting unit (not shown) that detects resistance of the secondary transfer portion, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P on which a toner image is transferred include a plain paper sheet which is used in an electrophotographic copying machine or a printer. In addition to the recording sheet P, examples of the recording medium also include an OHP sheet or the like.

In order to further improve the smoothness of the surface of the image after fixing is performed, it is preferable that the surface of the recording sheet P is smooth, and for example, a coated paper sheet which is prepared by coating a surface of the plain paper sheet with resin or the like, or an art paper sheet for printing, is appropriately used.

The recording sheet P on which the fixing of the color image is completed is discharged toward a discharge part, and a series of the color image forming operations ends.

Process Cartridge/Toner Cartridge

The process cartridge according to the exemplary embodiment will be described.

The process cartridge according to the exemplary embodiment is provided with a developing unit that accommodates the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include the developing unit, and at least one selected from other units, such as an image holding member, a charging unit, an electrostatic charge image forming unit, or a transfer unit, as necessary.

Hereinafter, an example of the process cartridge according to the exemplary embodiment will be described, but the exemplary embodiment is not limited thereto. In the following description, main parts shown in the drawing will be described, and the description of other parts will be omitted.

Figure 2:
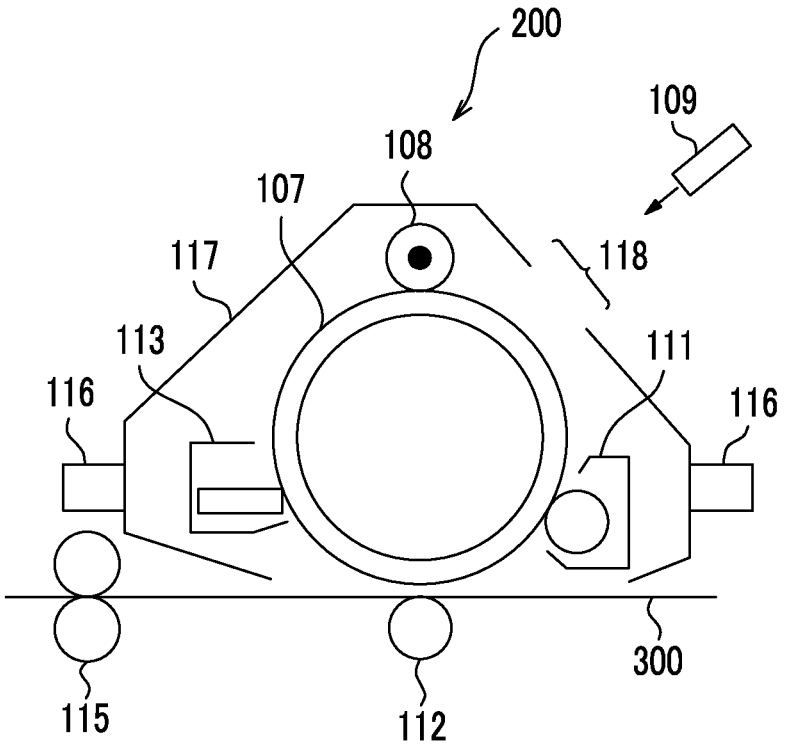
FIG. 2 is a schematic configuration diagram showing an example of a process cartridge according to the exemplary embodiment.

FIG. 2 is a schematic diagram showing a configuration of the process cartridge according to the exemplary embodiment.

A process cartridge 200 shown in FIG. 2 is formed as a cartridge having a configuration in which a photoreceptor 107 (an example of the image holding member) and, a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 2, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to the exemplary embodiment will be described.

The toner cartridge according to the exemplary embodiment accommodates the toner according to the exemplary embodiment and is detachable from an image forming apparatus. The toner cartridge accommodates a toner for replenishment to be supplied to the developing unit provided in the image forming apparatus.

The image forming apparatus shown in FIG. 1 is an image forming apparatus which has a configuration in which the toner cartridges 8Y, 8M, 8C, 8K, and 8W are detachably attached thereto, and the developing devices 4Y, 4M, 4C, 4K, and 4W are connected to the toner cartridges corresponding to the respective colors through toner supply tubes (not shown), respectively. In addition, when the amount of toner accommodated in the toner cartridge runs low, the toner cartridge is exchanged. An example of the toner cartridge according to the exemplary embodiment is the toner cartridge 8W.

EXAMPLE

Hereinafter, the exemplary embodiment will be described by Examples in detail. However, the exemplary embodiment is not limited to any one of these Examples.

In the following description, "parts" and "%" are based on weight unless otherwise specifically indicated.

Example 1

Preparation of Titanium Dioxide Particles (1)

963.8 parts of titanium tetrabutoxide as a raw material of titanium and 0.4 parts of niobium pentabutoxide as a raw material of niobium are mixed with each other, ethanol is added thereto, and the resultant mixture is stirred with a stirrer, while covering with a film is performed to prevent being touched by moisture. After this, titanium dioxide particles (1) are obtained by blowing the mixture into the ultra-high temperature plasma of argon atmosphere. The volume average particle diameter of the obtained particles is 35 nm.

Preparation of Titanium Dioxide Particle (1) Dispersion

Titanium dioxide particles (1): 100 parts

Anionic surfactant (NEOGEN RK manufactured by DKS Co., Ltd.): 5 parts

Ion exchange water: 100 parts

The above-described materials are mixed with each other, and dispersing is performed by using a homogenizer (ULTRA-TURRAX T50 manufactured by IKA) for 30 minutes. By adding the ion exchange water to adjust a solid content in the dispersion to 50%, the titanium dioxide particle (1) dispersion is obtained.

Preparation of Resin Particle Dispersion (1)

Terephthalic acid: 30 parts by mol

Fumaric acid: 70 parts by mol

Ethylene oxide adducts of bisphenol A: 5 parts by mol

Propylene oxide adducts of bisphenol A: 95 parts by mol

The above-described materials are put into a 5 L-flask which is provided with a stirring device, a nitrogen introduction pipe, a temperature sensor, and a rectifying column, the temperature is increased up to 210° C. at a period of one hour, and 1 part of titanium tetraethoxide with respect to 100 parts of the above-described materials is put thereinto. After increasing the temperature up to 230° C. at a period of 0.5 hours while distilling away the generated water and continuing a dehydrative condensation reaction for 1 hour at the temperature, the resultant is cooled. In this manner, polyester resin (1) having a weight average molecular weight of 18,500, an acid value of 14 mg KOH/g and a glass transition temperature of 59° C. is synthesized.

After putting 40 parts of ethyl acetate and 25 parts of 2-butanol into a container provided with a temperature adjusting unit and a nitrogen substituting unit to prepare a mixed solvent, 100 parts of the polyester resin (1) is slowly put thereinto and dissolved, and 10% of ammonia aqueous solution (equivalent to 3 times the acid value of the resin in a molar ratio) is put thereinto, followed by stirring for 30 minutes.

Next, the inside of the container is substituted with dry nitrogen, temperature is held at 40° C., 400 parts of ion exchange water are dropped at a rate of 2 parts/minute while stirring the mixed solution, and emulsification is performed. After finishing the dropping, as the temperature of the emulsified solution is returned to a room temperature (20° C. to 25° C.), and bubbling is performed for 48 hours by the dry nitrogen while stirring, to thereby reduce an amount of ethyl acetate and 2-butanol to 1000 ppm or less. Thus, the resin particle dispersion in which the resin particles having a volume average particle diameter of 200 nm are dispersed is obtained. By adding the ion exchange water to the resin particle dispersion and adjusting the solid content to 20%, the resin particle dispersion (1) is obtained.

Preparation of Release Agent Particle Dispersion (1)

Paraffin wax (HNP-9 manufactured by Nippon Seiro Co., Ltd.): 100 parts

Anionic surfactant (NEOGEN RK manufactured by DKS Co., Ltd.): 1 part

Ion exchange water: 350 parts

The above-described materials are mixed, the mixed materials are heated to 100° C., dispersed by using the homogenizer (ULTRA-TURRAX T50 manufactured by IKA), and are then subjected to a dispersion treatment by a Manton-Gaulin high-pressure homogenizer (manufactured by Gaulin Inc.). Thus, release agent particle dispersion (1) (solid content: 20%) in which the release agent particles having a volume average particle diameter of 200 nm are dispersed is obtained.

Preparation of White Toner Particle (1)

A device which connects a round flask made of stainless steel and a container A by a tube pump A, sends a liquid accommodated in the container A to the flask by driving the tube pump A, is prepared. In addition, by using this device, the following operations are performed.

Resin particle dispersion (1): 94 parts

Titanium dioxide particle (1) dispersion: 117 parts

Release agent particle dispersion (1): 35 parts

Anionic surfactant (TAYCAPOWDER manufactured by Tayca): 1 part

After putting the above-described materials into the round flask made of stainless steel, and adjusting pH levels to 3.5 by adding 0.1 N of nitric acid, 15 parts of nitric acid aqueous solution having 10% concentration of polyaluminum chloride is added thereto. Next, after dispersing is performed at 30° C. by using the homogenizer (ULTRA-TURRAX T50 manufactured by IKA), a particle diameter of the aggregated particles is grown while increasing the temperature at a rate of 1° C./30 minutes in an oil bath for heating.

After this, 40 parts of the resin particle dispersion (1) is smoothly added, and the obtained mixture is held for 1 hour, pH is adjusted to 8.5 by adding 0.1 N of sodium hydroxide aqueous solution. Then, heating of up to 85° C. is performed while stirring is continued, and the stirred material is held for 5 hours. After this, by cooling the temperature to 20° C. at a rate of 20° C./minute, filtrating, sufficiently cleaning by the ion exchange water, and drying, white toner particles (1) having a volume average particle diameter of 6.0 μm are obtained.

Preparation of White Toner Including an External Additive 100 parts of the toner particles (1) and 1.5 parts of silica particles (RY50 manufactured by Nippon Aerosil Co., Ltd.) with respect to 100 parts of the toner particles (1) are mixed by using a HENSCHEL mixer (manufactured by Mitsui Miike Machinery Co., Ltd.) at a circumferential speed of 30 m/second for 3 minutes. After this, a white toner including the external additive (1) is prepared by performing classification by using a vibrating sieve having an aperture of 45 μm.

Preparation of Developer 36 parts of the white toner including the external additive (1) and 414 parts of a carrier are put into a 2 L-V blender, and stirred for 20 minutes. After this, a developer is prepared by performing classification by using a sieve having an aperture of 212 μm. The carrier is prepared as follows.

Ferrite particle (volume average particle diameter: 35 μm): 100 parts

Toluene: 14 parts

Perfluoroacrylate copolymer: 1.6 parts

Carbon black (VXC-72 manufactured by Cabot Corporation): 0.12 parts

Cross-linked melamine resin particles (average particle diameter: 0.3 μm, toluene-insoluble): 0.3 parts First, the carbon black which is diluted in toluene is added to the perfluoroacrylate copolymer, and dispersing is performed by a sand mill. Next, the cross-linked melamine resin particles are added and the obtained mixture is dispersed by a stirrer for 10 minutes, and thus the coating layer forming solution is prepared. Next, after putting the coating layer forming solution and the ferrite particles into a vacuum deaeration type kneader, and performing stirring for 30 minutes at 60° C., toluene is distilled away under reduced pressure. In this manner, the ferrite particles are resin-coated to obtain a carrier.

Example 2

The white toner and the developer are prepared in a similar manner to that of Example 1, except that 0.4 parts of niobium pentabutoxide is changed to 0.8 parts of niobium pentabutoxide.

Example 3

The white toner and the developer are prepared in a similar manner to that of Example 1, except that 0.4 parts of niobium pentabutoxide is changed to 1.0 parts of niobium pentabutoxide.

Example 4

The white toner and the developer are prepared in a similar manner to that of Example 1, except that 0.4 parts of niobium pentabutoxide is changed to 0.2 parts of niobium pentabutoxide.

Example 5

The white toner and the developer are prepared in a similar manner to that of Example 1, except that 0.4 parts of niobium pentabutoxide is changed to 0.1 parts of niobium pentabutoxide.

Example 6

The white toner and the developer are prepared in a similar manner to that of Example 1, except that 0.4 parts of niobium pentabutoxide is changed to 0.4 parts of disodium hydrogen phosphate.

Example 7

The white toner and the developer are prepared in a similar manner to that of Example 1, except that 0.4 parts of niobium pentabutoxide is changed to 0.8 parts of disodium hydrogen phosphate.

Example 8

The white toner and the developer are prepared in a similar manner to that of Example 1, except that 0.4 parts of niobium pentabutoxide is changed to 1.0 parts of disodium hydrogen phosphate.

Example 9

The white toner and the developer are prepared in a similar manner to that of Example 1, except that 0.4 parts of niobium pentabutoxide is changed to 0.06 parts of disodium hydrogen phosphate.

Example 10

The white toner and the developer are prepared in a similar manner to that of Example 1, except that the resin particle dispersion (1) is changed to styrene acrylate resin dispersion (solid content: 20%).

Comparative Example 1

The white toner and the developer are prepared in a similar manner to that of Example 1, except that 0.4 parts of niobium pentabutoxide is changed to 0.02 parts of niobium pentabutoxide.

Comparative Example 2

The white toner and the developer are prepared in a similar manner to that of Example 1, except that 0.4 parts of niobium pentabutoxide is changed to 1.6 parts of niobium pentabutoxide and 1.6 parts of disodium phosphate.

Comparative Example 3

The white toner and the developer are prepared in a similar manner to that of Example 1, except that 0.4 parts of niobium pentabutoxide is changed to 0.02 parts of niobium pentabutoxide and 1.6 parts of disodium phosphate.

Comparative Example 4

The white toner and the developer are prepared in a similar manner to that of Example 1, except that 0.4 parts of niobium pentabutoxide is changed to 1.6 parts of niobium pentabutoxide and 0.02 parts of disodium phosphate.

Comparative Example 5

The white toner and the developer are prepared in a similar manner to that of Example 1, except that 0.4 parts of niobium pentabutoxide is changed to 0.4 parts of niobium pentabutoxide and 1.6 parts of disodium phosphate.

Comparative Example 6

The white toner and the developer are prepared in a similar manner to that of Example 1, except that 0.4 parts of niobium pentabutoxide is changed to 1.6 parts of niobium pentabutoxide and 0.4 parts of disodium phosphate.

Measurement

Measurement of Contents of Niobium and Phosphorous in Toner Particles by XRF

The surfactant (TAYCAPOWER manufactured by Tayca Co., Ltd.) is added to the ion exchange water, the toner is added thereto and dispersed, and ultrasonic waves are applied to the dispersion for 3 minutes. After this, the dispersion passes through a filter paper sheet (Filter Paper manufactured by Advantec Co., Ltd.), a residual on the filter paper sheet is washed by the ion exchange water and dried, and the toner particles are obtained.

By using a press-molding device, a disk having a diameter of 5 cm is prepared by applying 10 tons of compression pressure to 5 g of toner particles, and this is used as a measurement sample. By using an X-ray fluorescence spectrometer (XRF-1500 manufactured by Shimadzu Corporation), measurement is performed by setting a measuring condition to tube voltage of 40 KV, tube current of 90 mA, and measuring time of 30 minutes. The result thereof is shown in Table 1.

Evaluation

A modified machine (an image forming apparatus which is modified to operate even when the developer is not put into another developing device when the developer is put into one developing device) of APEOSPORT-II C4300 manufactured by Fuji Xerox Co., Ltd is prepared, and the developer is put into the developing device. Under an environment of a temperature of 32° C. and a moisture of 80%, an image is formed on a black paper sheet (M KENTORAXA BLACK manufactured by Heiwa Paper Co., Ltd.).

Deterioration of Whiteness of Image

At a fixing temperature of 160° C., a solid image (5 cm×5 cm) with a toner amount of 4.5 g/m$^2$ is formed. With respect to the formed solid image, ultraviolet irradiation (light source: 365 nm, irradiance: 9500 W/m$^2$) is performed for 2 hours by using an ultraviolet irradiation device (ULTRA-VIOLET LED IRRADIATOR LX405S manufactured by AS ONE corporation).

With respect to the solid image before and after the ultraviolet irradiation, a coordinate value of CIE 1976 L*a*b* color system is measured by using a spectral reflectance densitometer (X-Rite 939, aperture diameter is 4 mm), and whiteness W and a whiteness change ΔW are calculated by the following formulas. The result thereof is shown in Table 1.

$$\text{Whiteness } W=100-\{(100-L^*)^2+a^{*2}+b^{*2}\}^{0.5}$$

$$\text{Whiteness change } \Delta W=W0-W1$$

Here, W0 represents the whiteness before the ultraviolet irradiation, and W1 represents the whiteness after the ultraviolet irradiation. W0 and W1 are averages of 10 values which are obtained by measurement at arbitrary 10 locations in the solid image.

Evaluation Standard

A: ΔW=0 or greater and less than 1.0

B: ΔW=1.0 or greater and less than 1.5

C: ΔW=1.5 or greater and less than 2.0

D: ΔW=2.0 or greater

In addition, the lowest acceptable level is C.

Image Deletion

A half-tone image is formed, the image is visually observed, and image deletion is evaluated according to the following standard. The result thereof is shown in Table 1.

Evaluation Standard

1: Image deletion is not formed

2: Image deletion is slightly formed.

3: Image deletion is worse than 2, but there is no problem in a practical use, and this level is acceptable.

4: Image deletion is apparently determined, and this level cannot be provided for a practical use.

In addition, the lowest acceptable level is 3.

TABLE 1

| | White toner | | | | Evaluation | |
|---|---|---|---|---|---|---|
| | Type of binder resin | Content of titanium [% by weight] | Content of niobium [% by weight] | Content of phosphorous [% by weight] | Deterioration of whiteness of image | Image deletion |
| Comparative example 1 | Polyester | 35% | 0.001% | 0.000% | D | 1 |
| Comparative example 2 | Polyester | 35% | 0.080% | 0.080% | A | 4 |
| Comparative example 3 | Polyester | 35% | 0.001% | 0.080% | A | 4 |
| Comparative example 4 | Polyester | 35% | 0.080% | 0.001% | A | 4 |
| Comparative example 5 | Polyester | 35% | 0.020% | 0.080% | A | 4 |
| Comparative example 6 | Polyester | 35% | 0.080% | 0.020% | A | 4 |
| Example 1 | Polyester | 35% | 0.020% | 0.000% | A | 1 |
| Example 2 | Polyester | 35% | 0.040% | 0.000% | A | 2 |
| Example 3 | Polyester | 35% | 0.050% | 0.000% | A | 3 |
| Example 4 | Polyester | 35% | 0.010% | 0.000% | B | 1 |
| Example 5 | Polyester | 35% | 0.005% | 0.000% | C | 1 |
| Example 6 | Polyester | 35% | 0.000% | 0.020% | B | 1 |
| Example 7 | Polyester | 35% | 0.000% | 0.040% | B | 2 |
| Example 8 | Polyester | 35% | 0.000% | 0.050% | B | 3 |
| Example 9 | Polyester | 35% | 0.000% | 0.003% | C | 1 |
| Example 10 | Styrene-acryl | 35% | 0.020% | 0.000% | B | 2 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing white toner comprising:

toner particles that contain a binder resin, a titanium dioxide as a pigment, and at least one selected from a group consisting of niobium and phosphorous, wherein an amount of the niobium is 0.005% by weight to 0.05% by weight or an amount of the phosphorous is 0.003% by weight to 0.05% by weight.

2. The electrostatic charge image developing white toner according to claim 1, wherein the binder resin contains a polyester resin.

3. The electrostatic charge image developing white toner according to claim 1, wherein the toner particles contain 20% by weight to 80% by weight of titanium dioxide.

4. The electrostatic charge image developing white toner according to claim 1, wherein the toner particles contain 40% by weight to 70% by weight of titanium dioxide.

5. The electrostatic charge image developing white toner according to claim 1, wherein the toner particles contain 20% by weight to 50% by weight of titanium.

6. The electrostatic charge image developing white toner according to claim 1, wherein the toner particles contain 0.01% by weight to 0.05% by weight of niobium.

7. The electrostatic charge image developing white toner according to claim 1, wherein the toner particles contain 0.02% by weight to 0.04% by weight of niobium.

8. The electrostatic charge image developing white toner according to claim 1, wherein the toner particles contain 0.01% by weight to 0.05% by weight of phosphorous.

9. The electrostatic charge image developing white toner according to claim 1, wherein the toner particles contain 0.02% by weight to 0.04% by weight of phosphorous.

10. An electrostatic charge image developer, comprising:

the electrostatic charge image developing white toner according to claim 1; and a carrier.

11. The electrostatic charge image developer according to claim 10, wherein the binder resin contained in the electrostatic charge image developing white toner contains a polyester resin.

12. The electrostatic charge image developer according to claim 10, wherein the toner particles of the electrostatic charge image developing white toner contain 20% by weight to 80% by weight of titanium dioxide.

13. A toner cartridge that accommodates the electrostatic charge image developing white toner according to claim 1, and is detachable from an image forming apparatus.

14. The toner cartridge according to claim 13, wherein the binder resin contained in the electrostatic charge image developing white toner contains a polyester resin.

15. The toner cartridge according to claim 13, wherein the toner particles contained in the electrostatic charge image developing white toner contain 20% by weight to 80% by weight of titanium dioxide.

* * * * *